United States Patent [19]

Rose, Jr.

[11] 4,311,165

[45] Jan. 19, 1982

[54] HOSE REEL AUTOMATIC BRAKE

[75] Inventor: George R. Rose, Jr., East Patchogue, N.Y.

[73] Assignee: Grumman Aerospace Corporation, Bethpage, N.Y.

[21] Appl. No.: 98,982

[22] Filed: Nov. 30, 1979

[51] Int. Cl.[3] ..... E03B 9/00

[52] U.S. Cl. ..... 137/355.12; 137/355.21; 137/355.26; 239/199

[58] Field of Search ..... 137/355.12, 355.21, 137/355.26, 355.27; 239/195, 197, 198, 199; 242/86

[56] References Cited

U.S. PATENT DOCUMENTS

| | | | |
|---|---|---|---|
| 2,499,909 | 3/1950 | Fox | 242/86 |
| 2,726,828 | 12/1955 | Paskow . | |
| 2,906,472 | 9/1959 | Hannay et al. . | |
| 3,396,747 | 8/1968 | Moore | 137/355.21 |

*Primary Examiner*—Gerald A. Michalsky
*Attorney, Agent, or Firm*—Mellor A. Gill

[57] ABSTRACT

A braking system for a reel for a hose used to dispense fluids. The reel end of the hose is provided with a fluid connection on the reel itself and a supply line for the fluid is connected into the reel such that a flow can be established through the hose even though hose is still wound on the reel. A brake with actuating means is provided for the reel. Various types of brakes such as a caliper-disc type, a band and drum type, or a double-shoe type can be used. Brake actuation is by means of a pressurized hydraulic or pneumatic fluid or by an electrically operated solenoid. A flow sensor is incorporated in the fluid supply line to the hose and the output of the sensor is used to enable the brake actuator to brake the reel. In this system, when the flow sensor detects a flow through the hose, the sensor produces an output signal which is used to cause the actuation of the reel brake. In operation, to apply the reel brake such as to stop the unwinding of the hose when it is being pulled from the reel, the hoseman merely opens the valve in the hose nozzle to initiate a flow through the hose and the brake is applied automatically.

13 Claims, 4 Drawing Figures

HOSE REEL AUTOMATIC BRAKE

BACKGROUND OF THE INVENTION

1. Field of the Invention

This invention relates to an automatic brake for hose reels and, more particularly, to a hose reel brake which is actuated automatically by a flow of fluid through the hose.

2. Description of the Prior Art

It is known in the prior art to provide braking mechanisms which are employed on various types of reels of general utility, particularly for use as a braking and locking means for hose reels installed on fire and crash trucks. In such applications, it is necessary that the hose, which is also known as a hand line, should always be ready for use by pulling the hose quickly and expeditiously from the reel, but it has been believed necessary that the momentum of the reel be stopped automatically when the desired length of hose has been unwound to prevent over-running of the reel and the unnecessary unwinding of an excessive amount of hose. An example of a prior art hose reel brake is the design disclosed by D. C. Hannay et al in U.S. Pat. No. 2,906,472. The mechanism disclosed therein comprises a horizontal brake control bar that extends across the hose reel in contact with the hose and which is in direct connection with a brake shoe adapted to be actuated into engagement with a brake disc secured on the reel supporting shaft. The arrangement is such that the control bar is operable when the hose is tensioned on being pulled from the reel to permit the brake shoe to assume a non-braking relation with the brake disc, and with the control bar being otherwise operable when the hose is untensioned to thereby actuate said brake shoe laterally into engagement with the brake disc to provide an automatic braking and locking action on the reel. A further design in the prior art operable by the tension on the hose but which uses a drum-type brake instead of a disc-type brake is disclosed by W. B. Pashkow in the U.S. Pat. No. 2,726,828. The systems of Hannay, et al and Pashkow utilize a hose-tension activated horizontal bar or roller to actuate braking systems of the mechanical type; however, it is also known in the prior art to use similar horizontal bar systems to actuate a pneumatically operated reel brake. These reel air brake systems are generally truck-mounted installations which are supplied with compressed air from the vehicle air brake system.

A disadvantage of these prior art systems is that the horizontal brake control bar or roller results in a cumbersome unwieldy installation that is susceptible to interference with or from adjacent operating equipment. A more serious objection to these hose-tension related systems is that unless the hose is prevented from drooping onto the ground or road when it is being unreeled, there is nothing to stop the roller from dropping, thereby causing the brake to be activated to prohibit the unreeling of any more hose. Considering the weight of the hose, this drooping of the hose and subsequent operation of the brake happens repeatedly, causing problems in drawing out the necessary hose. To permit an unimpeded unreeling of hose, it is generally required to have a man standing by to prevent the unwanted activation of the reel brake.

SUMMARY OF THE INVENTION

The present invention is an automatic braking system for hose reels, particularly for reels of the continuous-flow types provided with the necessary piping and ancillary equipment to permit a flow through the hose even while a length thereof is still wound on the reel. In this system, the reel brake is activated by a flow of fluid through the hose. When there is not a flow through the hose, the reel is free to rotate to permit the unreeling or reeling of hose thereon. To actuate the reel brake, this system is provided with a flow sensor or detector in the supply line to the hose and connections between the sensor and the brake actuator. When a flow of fluid through the hose is detected, the sensor produces an output signal that activates the brake actuator to apply the reel brake.

It is a principal object of the invention, therefore, to provide a hose reel braking system that brakes the rotation of the reel as the function of a flow through the hose.

It is another object of the invention to provide a hose reel braking system in which brake actuation does not require any mechanical encumbrance or restrictions on the hose being reeled or unreeled.

It is a further object of the invention to provide a hose reel braking system in which the reel may be rotated freely to permit the reeling or unreeling of hose therefrom but in which the reel is automatically braked merely by opening the hose nozzle such that there is a flow therethrough.

Yet another object of the invention is to provide a hose reel braking system that does not depend on hose tension or position for actuation of the reel brake.

Still another object of the invention is to accomplish the foregoing objects in a practical, safe, and reliable manner.

Other and further objects of the invention will be obvious upon an understanding of the illustrative embodiments about to be described, or will be indicated in the appended claims, and various advantages not referred to herein will occur to one skilled in the art upon employment of the invention in practice.

DESCRIPTION OF THE DRAWINGS

For the purpose of illustrating the invention, there is shown in the drawings the forms which are presently preferred; it should be understood, however, that the invention is not necessarily limited to the precise arrangements and instrumentalities shown.

DESCRIPTION OF THE PREFERRED EMBODIMENT

Figure 1:
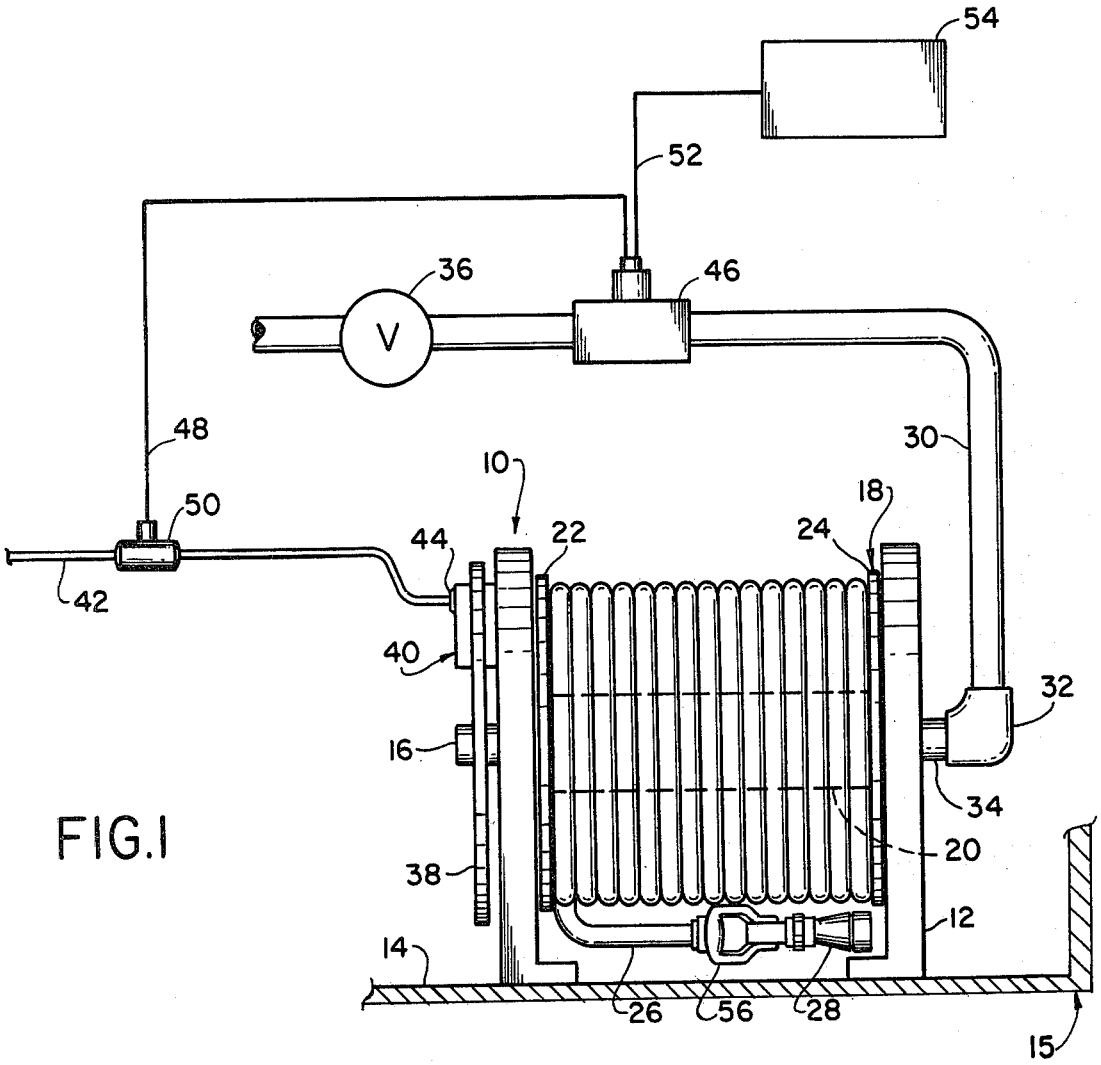
FIG. 1 is a schematic representation of a hose reel embodying a braking arrangement of the invention.

Referring now to the drawings, particularly to FIG. 1, a hose reel, generally designated as 10, as mounted on a supporting structure or framework 12 which rests on or is fastened on a suitable surface 14. The surface, for example, can be the deck or floor in a convenient location on a fire truck 15. It will be appreciated that the braking system of this invention can be employed with advantage with hose reels of various types for use in a variety of applications. However, the invention is particularly useful when utilized with continuous-flow reels for fire hoses and, for convenience, the following description will be focused on fire fighting equipment in which water is the working fluid, but any limitation thereto is not implied by this emphasis. The reel 10 is provided with a shaft 16 which is supported for rotation by suitable bearings at the opposite sides of the supporting structure 12. Reel 10 comprises a spool 18 having the usual hollow cylindrical drum 20 provided with end plates or discs 22, 24. A length of fire hose 26 having a nozzle 28 is shown stowed on the spool 18. As is well known, the nozzle 28 preferably is of the type with which it is possible to regulate the flow rate and to initiate and cut off the flow therethrough. If desired, the reel can be provided with rewind means and other conventional appurtenances (not shown). In a preferred embodiment, the reel 10 is of the continuous-flow type in which the piping 30 from a suitable supply source (not shown) is connected to a swivel joint inlet 32 which, in turn, passes through the reel hub 34 and is connected to the reel end of the hose by an outlet riser (not shown) such that water can be dispensed through the hose even though a length of it is still wound on the reel. As is the usual practice, a shut-off valve 36 is fitted in the supply pipe 30.

Fixed on the end portion of reel shaft 16 outboard of the support structure 12 is a brake disc 38 operatively associated with a caliper-type air brake 40 fixed on the support structure. Air under pressure to actuate air brake 40 is provided by a suitable supply source (not shown) through air line 42 connected to the air inlet fitting 44 of the brake. As is well known, the pressurized air source for the brake may be a compressor mounted on the fire truck or air from the air brake system of the vehicle can be used. A suitable hose reel equipped with an air brake of the type described above is available commercially from Clifford B. Hannay & Son, Inc., Westerlo, N.Y.

Brake actuation is controlled by a flow sensor 46 in the water supply pipe 30. Sensor 46 is connected by means of a suitable electrical circuit 48 to an electric solenoid actuated air valve 50 in the air line 42 to the air brake 40. Electrical energy for actuating the air valve 50 is supplied through line 52 connected to a source of electricity 54 which can be a battery or the electrical generator or alternator of the vehicle upon which the hose reel is mounted. I have found the paddle-valve type Model No. FS550 Flow Switch commercially available from Delaval Special Products Division, Delaval Turbine, Inc., Cleveland, Ohio and the ACCO No. 831654 three-way Solenoid Valve, commercially available from the Automatic Switch Co., Florham Park, N.J., to meet the requirements for the flow sensor 46 and air valve 50 respectively.

In operation, the shut-off valve 36 is opened to prime the system. Once the hose 26 is full of water, the reel spool 18 will turn freely to allow hose to be wound or unwound therefrom. Thus, when the equipment arrives at the scene of a fire, for example, the hoseman needs merely to pull on the end of the hose to unwind it from the reel for use. When a sufficient length of hose is unreeled and it is desired to brake the reel, the hoseman turns on the water as by opening valve 56 on the hose nozzle 28. The flow of water through the system is detected by flow sensor 46 which transmits an electrical signal through circuit 48 to the air valve 50 in brake air line 42, opening that valve to initiate a flow of pressurized air to the reel brake 40 to brake the reel spool 18 from further rotation. The brake will remain applied as long as there is a flow of water through the hose 26. Should it be desired to unbrake the reel to permit the reeling or unreeling of hose, the hoseman closes valve 56 on the nozzle to shut off the flow of water. Cessation of the water flow is detected by flow sensor 46 which thereupon de-energizes the solenoid in the air valve 50, to close the valve and cut off the pressurized air to brake 40, releasing the brake and freeing the reel for rotation.

In the FIG. 1 embodiment of the invention, the reel brake is a pneumatic brake. Other types of brakes suitable for use are well known such as the hydraulically actuated disc brake 10A shown in FIG. 2. As shown, brake 10A is of the caliper type suitably mounted on the reel framework 12A in operative association with the reel brake disc or rotor 38A. Hydraulic brake 10A has a body portion 60 which has a cylindrical bore 62 therein in which a piston 64 operates. Fixed on the end 66 of the piston is a pad 68 of brake-type friction material which has a coaxial relationship with a second pad 70 fabricated out of the same material. The back 72 of pad 70 is suitably fastened to surface 74 of the brake body. Reel disc 38A fixed on the shaft of the reel spool in a manner idential to that shown in the FIG. 1 embodiment rotates between the faces 76 and 78 of the brake pads. The brake is actuated by pressurized hydraulic fluid supplied to the brake through hydraulic line 80 from a conventional source (not shown). Suitable passageways 82 are provided in the brake body for the passage of hydraulic fluid from line 80 to the bore 62 which houses piston 64. The other components of the brake actuating system such as the flow sensor and the like are identical to those of the FIG. 1 embodiment with the exception that a hydraulic valve 84 is used instead of the air valve 50.

Figure 2:
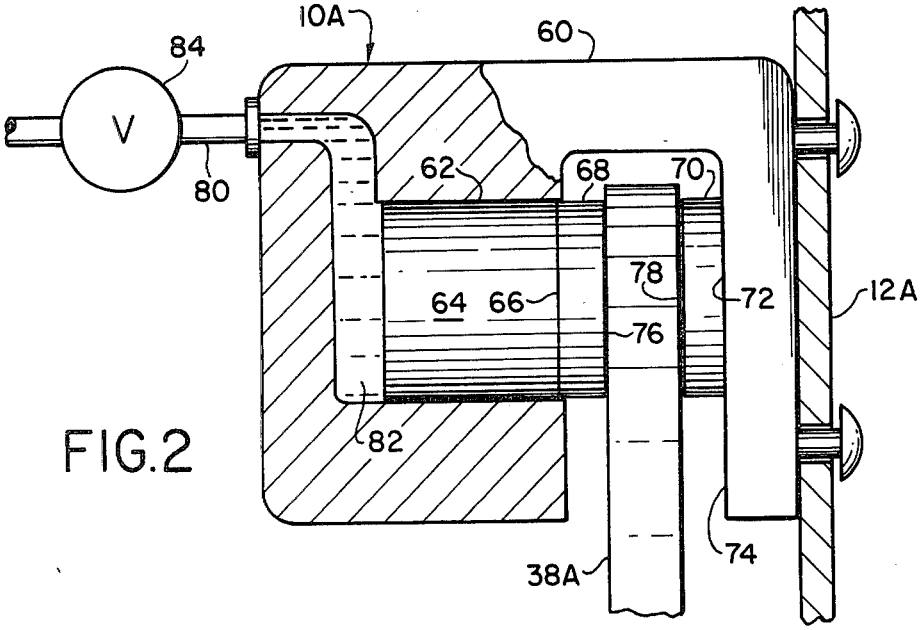
FIG. 2 is a front elevational view partially in section of a caliper type hydraulic brake embodied in the invention.

The operation of the FIG. 2 embodiment is essentially a hydraulic analog of the FIG. 1 pneumatic system. Thus, when the hoseman desires to brake the reel, he opens the valve in the nozzle to initiate a flow therethrough. This flow is detected by the flow sensor which transmits an electrical signal to the solenoid of hydraulic valve 84, opening the valve such that hydraulic fluid under pressure flows through line 80 and through passageways 82 to actuate piston 64. When piston 64 is actuated, it forces brake pads 68 and 70 into contact with the reel disc 38A, braking the reel spool. Hydraulic pressure on the brake pads is relieved to release the brake when the hoseman shuts off the hose nozzle as described for the FIG. 1 embodiment.

Figure 3:
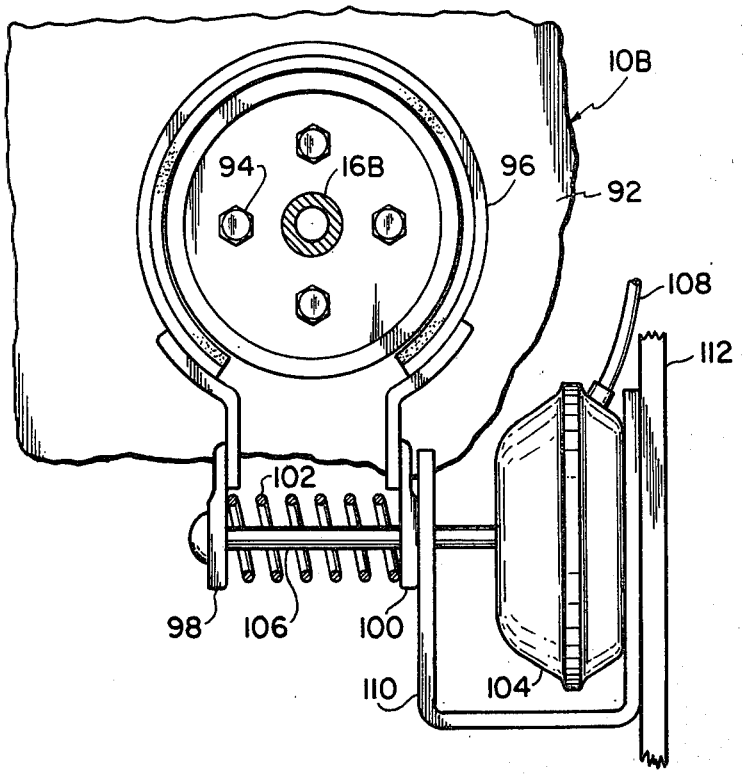
FIG. 3 is a fragmentary side elevational view of a hose reel provided with a band-type pneumatic reel brake embodied in the invention.

A further example of a brake useable in the system of my invention is illustrated in FIG. 3. The hose reel generally designated as 10B, is mounted on a supporting framework 112 (shown in fragmentary section) by means of a shaft 16B. A brake drum 90 is rigidly fixed on one end 92 of the reel by suitable means such as bolts 94. A brake band 96 surrounds the brake drum 90, terminating at its lower portion in two free ends 98 and 100 which are biased away from each other by a spring 102. Brake band 96 is brought into braking engagement with brake drum 90 by means of a pneumatic actuator 104 which applies a pull on an actuator rod 106 to thereby move the free ends 98 and 100 of the brake band 96 toward one another. Actuator 104 which is connected to the braking system airs supply (not shown) by an air line 108, is mounted by a bracket 110 on framework 112 of the reel 10B.

With the exception that the braking system illustrated in FIG. 3 incorporates a drum-type brake, the other components of the system, including the flow detector and the air valve associated therewith for admitting air under pressure to the brake, are identical to those shown for the FIG. 1 embodiment. Thus, the operation is identical except that the flow of pressurized air to the brake actuator that is initiated when the hoseman turns on the nozzle tightens the brake band against the brake drum to brake the reel instead of moving a brake pad into frictional engagement with the reel disc for the purpose.

Figure 4:
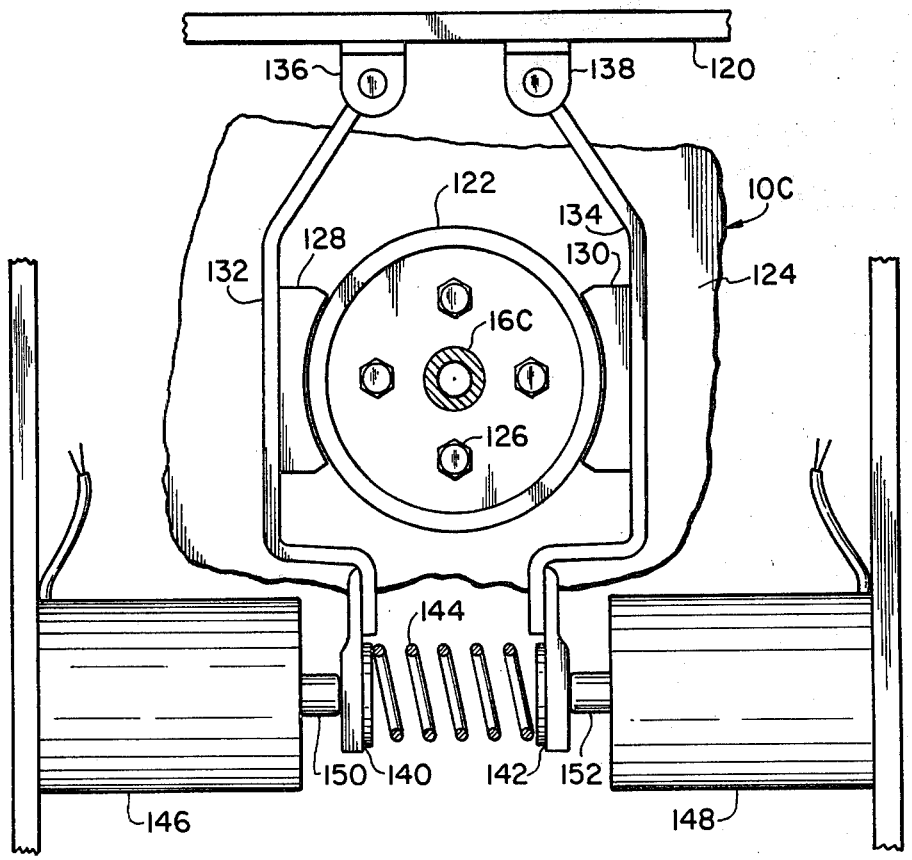
FIG. 4 is a fragmentary side elevational view of a hose reel provided with an electrically actuated double shoe reel brake embodied in the invention.

FIG. 4 illustrates a further alternative braking system in which brake actuation is by means of electrical solenoids. The hose reel, generally designated as 10C, is supported on a framework 120 (shown in fragmentary section) by means of a shaft 16C. A brake drum 122 is rigidly fixed on one end 124 of the reel by suitable means such as bolts 126. Brake shoes 128 and 130 associated with the brake drum 122 are fixed on brake arms 132 and 134 respectively which are pivotally mounted on reel framework 120 by means of brackets 136 and 138. The free ends 140 and 142 of the brake arms 132 and 134 are biased away from one another by spring 144. Brake actuation is by means of solenoids 146 and 148, the ends 150 and 152 of the armatures of which engage free ends 140 and 142 of the brake arms. With the exception that the FIG. 4 embodiment utilizes a double-shoe brake, it is an electrical analog of the FIG. 1 embodiment. Thus, the complete system would have all of the components shown in FIG. 1 except that the electrical signal generated by the flow sensor when it detects a flow of water will be transmitted through suitable circuitry to activate the solenoids 146 and 148 directly, thereby applying the double-shoe brake to bring the reel spool to a stop. Double shoe brakes are well-known in the art and the actuation of devices by means of electrical solenoids is also commonplace; thus, it is not believed that it would serve any useful purpose to provide a detailed description thereof. Suffice it to say; however, that when the hoseman wants to brake the reel, he opens the valve in the hose nozzle to initiate a flow therethrough. This flow is detected by the flow sensor which transmits an electrical impulse to solenoids 146 and 148. Energizing the solenoids forces their armatures outwardly causing the ends 150 and 152 thereof to move the brake arms 132 and 134 against the tension of spring 144 to thereby force the brake shoes 128 and 130 against brake drum 122 to brake the reel. To release the brake, the hoseman merely shuts off the hose nozzle which results in the solenoids being de-energized. The tension of spring 144 is then sufficient to force brake arms 132 and 134 apart to take the brake shoes 128 and 130 out of braking contact with the brake drum.

Although shown and described in what are believed to be the most practical and preferred embodiments, it is apparent that departures from the specific method and apparatus described will suggest themselves to those skilled in the art and may be made without departing from the spirit and scope of the invention. I, therefore, do not wish to restrict myself to the particular instrumentalities illustrated and described, but desire to avail myself of all modifications that may fall within the compass of the appended claims.

Having thus described my invention, what I claim is:

1. In a reel for the stowage of a length of hose, a support mounting said reel on a shaft for rotation for the reeling and unreeling of said hose, a supply line for supplying fluid to said hose for dispensing therefrom, and means for braking the rotation of said reel, said braking means comprising, in combination:

a brake rotor fixed on said reel and rotating therewith;

a brake stator mounted on said support in operative association with said brake rotor;

a brake actuator for moving said brake stator into frictional engagement with said brake rotor, said stator normally being substantially out of engagement with said rotor such that said reel is free to rotate, said reel being braked against rotation when said actuator brings said stator into engagement with said rotor;

energizing means for activating said brake actuator; and sensing means in the supply line for said hose responsive to a flow therethrough for enabling said energizing means to activate said brake actuator whereby a flow of fluid through said hose causes said reel to be braked against rotation.

2. The hose reel of claim 1 wherein the brake rotor is a disc and wherein the brake stator has a friction pad which in the braking operation is moved by the brake actuator into frictional engagement with said disc to brake said reel.

3. The hose reel of claim 1 wherein the brake rotor is a drum and wherein the brake stator is a band substantially surrounding said drum in an arrangement such that the brake actuator in the braking operation tightens said band on said drum to produce a frictional engagement that brakes said reel.

4. The hose reel of claim 1 wherein the brake actuator is a fluid-operated piston and cylinder arrangement.

5. The hose reel of claim 4 wherein the energizing means for activating the brake actuator is a hydraulic fluid.

6. The hose reel of claim 4 wherein the energizing means for activating the brake actuator is a pneumatic fluid.

7. The hose reel of claim 4 wherein said reel is carried by a motor vehicle and wherein the fluid for activating the brake actuator is derived from a vehicle pressure system.

8. The hose reel of claim 1 wherein the energizing means for activating the brake actuator is an electrical signal.

9. The hose reel of claim 8 wherein the brake actuator is an electrically operated solenoid.

10. The hose reel of claim 1 wherein the sensing means has an output which is connected to the energizing means and wherein a signal produced by said sensing means in response to a flow of fluid therethrough enables said energizing means to activate the brake actuator.

11. The hose reel of claim 10 wherein the output of the sensing means is an electrical signal.

12. The hose reel of claim 10 wherein the sensing means is a paddle valve.

13. The hose reel of claim 1 wherein the hose is provided with a nozzle, said nozzle being adjustable to vary the flow therethrough from fully open through intermediate flow rates to full shutoff, and wherein the reel brake is automatically actuated by opening the nozzle to initiate a flow therethrough.

* * * * *